US011759070B2

(12) United States Patent
Smiley

(10) Patent No.: US 11,759,070 B2
(45) Date of Patent: Sep. 19, 2023

(54) PORTABLE VACUUM CLEANER

(71) Applicant: Doris Smiley, Beavercreek, OH (US)

(72) Inventor: Doris Smiley, Beavercreek, OH (US)

( * ) Notice: Subject to any disclaimer, the term of this patent is extended or adjusted under 35 U.S.C. 154(b) by 0 days.

(21) Appl. No.: 17/391,846

(22) Filed: Aug. 2, 2021

(65) Prior Publication Data

US 2023/0035714 A1 Feb. 2, 2023

(51) Int. Cl.

| | |
|---|---|
| ***A47L 5/24*** | (2006.01) |
| ***A47L 9/28*** | (2006.01) |
| ***A47L 9/06*** | (2006.01) |
| ***A47L 9/32*** | (2006.01) |
| ***A47L 9/14*** | (2006.01) |

(52) U.S. Cl.

CPC ..... *A47L 9/066* (2013.01); *A47L 5/24* (2013.01); *A47L 9/1418* (2013.01); *A47L 9/2857* (2013.01); *A47L 9/2884* (2013.01); *A47L 9/322* (2013.01)

(58) Field of Classification Search

CPC ... A47L 9/066; A47L 5/24; A47L 5/28; A47L 5/32; A47L 9/24; A47L 9/36; A47L 9/1418; A47L 9/2857; A47L 9/2884; A47L 9/322; A47L 7/0014; A47L 9/248

USPC ..... 15/314

See application file for complete search history.

(56) References Cited

U.S. PATENT DOCUMENTS 4,476,607 A * 10/1984 Ross ..... A47L 9/02 15/422
4,706,327 A * 11/1987 Getz ..... A47L 9/0411 15/354
7,870,640 B2 * 1/2011 Hinklin ..... A47L 5/14 15/330
2006/0130270 A1 * 6/2006 Tondra ..... A47L 9/2805 15/361
2010/0186188 A1 * 7/2010 Williams ..... A47L 5/24 15/344
2011/0094051 A1 4/2011 Gripske et al.
2011/0214567 A1 9/2011 McClearen et al.
2011/0252593 A1 * 10/2011 Gerhards ..... A47L 9/2826 15/319
2013/0255029 A1 10/2013 Wolfe, Jr. et al.
2013/0289504 A1 10/2013 Esnouf
2013/0312214 A1 * 11/2013 Johnson ..... E01H 1/006 15/339
2017/0105591 A1 4/2017 Bernhard-Tanis
2017/0280630 A1 * 10/2017 Smyers ..... A01G 20/47
2018/0132682 A1 5/2018 Bearup et al.
2018/0235418 A1 * 8/2018 Lauer ..... A47L 9/2884

* cited by examiner

*Primary Examiner* — Anne M Kozak
*Assistant Examiner* — Tyler James McFarland

(57) ABSTRACT

The present invention discloses a portable vacuum cleaner having a rotatable vacuum assembly. The vacuum cleaner comprises a nozzle assembly including a nozzle cavity, a canister assembly pivotally connected to the nozzle assembly, a dust bag mounted to the canister assembly, a dirty air pathway providing fluid communication between the nozzle cavity and the dust bag and a suction generator for generating a vacuum that draws dirt and debris from the nozzle cavity to the dust bag. The nozzle assembly having a nozzle mount rotatably coupled to the canister assembly to spin about a rotation axis and an angled nozzle rigidly extending from the nozzle mount at an acute angle to the rotation axis. The nozzle assembly is adapted to rotate and could move back and forth for effective collection of dirt and debris.

4 Claims, 6 Drawing Sheets

PORTABLE VACUUM CLEANER

TECHNICAL FIELD

The present disclosure relates generally to a vacuum cleaner, and more particularly, to a portable vacuum cleaner having a rotatable nozzle assembly that is lightweight, compact, time-saving, efficient, and reduces labor.

BACKGROUND

Various vacuum cleaners have been developed for cleaning floors, etc. by drawing in air and dust together. Vacuum cleaners generally include a nozzle assembly which is adapted to ride over the floor surface to be cleaned. A canister assembly is pivotally mounted to the nozzle assembly. The canister assembly includes an operating handle that is manipulated by the user to move the vacuum cleaner back and forth across the floor.

However, the nozzles are rigidly mounted on a vacuum cleaner frame, and wheels support the frame for movement across an area to be cleaned. Such arrangements are suitable on surfaces that are leveled, but when used out of doors on uneven ground, the nozzle rises or falls as the wheels move over bumps and depressions on the ground. This results in a change in the location of the nozzle mouth with respect to the ground, which affects the suction efficiency. In addition, existing nozzles are not flexible and reaching inaccessible areas in indoors such as behind shrubbery, under workbenches are not possible.

Thus, there exists a need for a portable vacuum cleaner having a nozzle assembly that could be used both indoors and outdoors, which solves the problems and eliminates the difficulties encountered with the described prior vacuum cleaner construction, in an efficient, simple, and relatively inexpensive manner.

SUMMARY

The present invention relates generally to an air moving apparatus, and more particularly to a portable, hand-held, blower/vacuum unit used, for example, to blow away or vacuum up ground debris such as dirt, leaves, grass clippings, dust and the like.

More particularly, the present invention discloses a portable blower/vacuum cleaner having a rotatable vacuum assembly. In one or more embodiments, the portable vacuum cleaner is an indoor and outdoor vacuum cleaner. In one or more embodiments, the portable vacuum cleaner is adapted for vacuuming as well as converting to blowing air. In one or more embodiments, the portable vacuum cleaner comprises a long slender nozzle adapted to sway from side to side. On the inside, the portable vacuum cleaner can be used for deep cleaning when locked in place. In one or more embodiments, the slender nozzle makes it easy for cleaning couches and tight crevices, removing cobwebs from hard-to-reach places, and removing dust from draperies. On the outside, the portable vacuum cleaner can perform multiple tasks including vacuuming automobiles, blowing leaves to the side, and professional landscaping jobs.

The vacuum cleaner comprises a nozzle assembly including a nozzle cavity, a canister assembly pivotally connected to the nozzle assembly, a dust bag mounted to the canister assembly, a dirty air pathway providing fluid communication between the nozzle cavity and the dust bag and a blower/vacuum unit (suction generator), operable for generating a partial vacuum and blowing/suctioning flowing air.

In one or more embodiments, the suction generator is operable for generating a vacuum that draws dirt and debris from the nozzle cavity to the dust bag. In one or more embodiments, the suction generator is operable for generating a blowing stream of air directed out of the nozzle. The nozzle assembly having a nozzle mount rotatably coupled to the canister assembly to spin about a rotation axis and an angled nozzle rigidly extending from the nozzle mount at an acute angle to the rotation axis. The nozzle assembly is adapted to rotate and could move back and forth for effective collection of dirt and debris. In one or more embodiments, the portable vacuum cleaner further comprises an integral air filter. In one or more embodiments, the blowing/suction generator may be used in conjunction with various gas and electric blower/vacuum motors, both novel and conventional. In one or more embodiments, the suctioned/blowing volume of air provided by the blower/vacuum unit is greater than 30, 40, 50, 60 or more CFM.

The vacuum cleaner further comprises a nozzle adjusting assembly including an adjustable pin and a lever mounted to the nozzle assembly to rotate the nozzle mount. In one embodiment, the suction generator includes a suction fan and associated drive motor. In one embodiment, the canister assembly is enclosed in a housing having a cavity. The cavity includes at least one drive motor compartment housing the suction generation and at least one dust bag compartment at which the dust bag is mounted. The vacuum cleaner further includes a handle and a shoulder strap disposed on the housing. The vacuum cleaner further comprises a battery compartment having one or more batteries to power the suction generator and the nozzle assembly. The vacuum cleaner further comprises one or more control switches mounted on the housing to control the portable vacuum cleaner.

DETAILED DESCRIPTION OF EXAMPLE EMBODIMENTS

Example embodiments of the disclosure now will be described more fully hereinafter with reference to the accompanying drawings, in which example embodiments are shown. The concepts discussed herein may, however, be embodied in many different forms and should not be construed as limited to the example embodiments set forth herein; rather, these embodiments are provided so that this disclosure will be thorough and complete, and will fully convey the scope to those of ordinary skill in the art. Like numbers refer to like elements but not necessarily the same or identical elements throughout.

Figure 1:
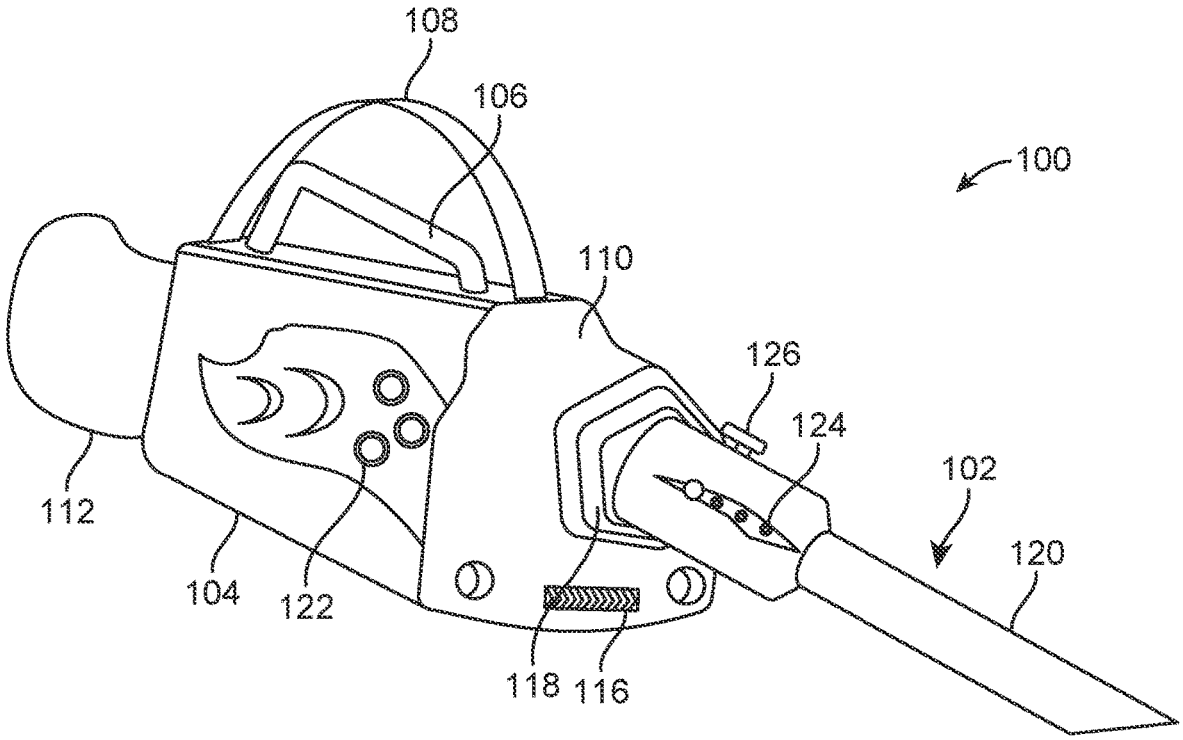
FIG. 1 exemplarily illustrates a perspective view of a portable vacuum cleaner, according to an embodiment of the present invention.

Referring to FIG. 1, the portable vacuum cleaner 100 comprises a nozzle assembly 102 defining a nozzle cavity, and a canister assembly 104 is pivotally connected to the nozzle assembly 102. The canister assembly 104 includes a handle 106 equipped with a hand grip. The canister assembly 104 is enclosed by a housing 110 including a cavity. A shoulder strap 108 is provided on the top portion of the housing 110 for carrying the portable vacuum cleaner 100 with ease. The cavity includes at least one drive motor compartment for housing a fan and a drive motor and at least one dust bag compartment for receiving dirt and debris. A dust bag 112 for collecting dirt and debris is removably mounted to the dust bag compartment by a bag mount.

In one or more embodiments, the drive motor comprises any novel or conventional electrical-powered motor or fuel-driven engine that provides sufficient blowing/sucking power for a desired application. These drive motors may be pull-start or switch-start units, and may be selectively operated in blowing or sucking mode, depending upon the desired application. For example, the portable vacuum cleaner 100 may be operated in sucking mode generating a partial vacuum with suctioned high volume flowing air to clean debris and then in blowing mode. In one or more embodiments, the drive motor is pivotally connected to the nozzle assembly 102.

In one or more embodiments, a suction fan and associated drive motor are held in the fan and drive motor compartment of the housing 110. The drive motor is driven by one or more batteries provided in a battery compartment. The battery compartment may be formed integral to the housing 110. This suction fan and drive motor draw air including entrained dirt and debris lifted by the rotating agitators from the nozzle cavity through an air pathway generally to the dust bag 112. The dust bag 112 serves to trap the suspended dirt, dust, and other particles inside while allowing the now clean air to pass freely into the dust bag compartment. The suction fan and the drive motor together define a suction generator for generating a vacuum that draws dirt and debris from the nozzle cavity to the dust bag 112. The cleaned air then is drawn through an integral, secondary air filter (not shown) into the fan and drive motor compartment. The air passes over the fan and drive motor and is ultimately exhausted through the final filtration cartridge and the exhaust port 116 into the environment. From the previous description, it should be appreciated that the air pathway provides fluid communication between the nozzle cavity and the dust bag 112. In one or more embodiments, the suctioned/blowing volume of air provided by the blower/vacuum unit is greater than 30, 40, 50, 60 or more CFM. In another embodiment, the suctioned/blowing volume of air provided by the blower/vacuum unit is at least 60, 70, 80, 90, 100 or more CFM. In one or more embodiments, the integral filter serves as an air-cleansing medium to contain small airborne dust and dirt particulates from discharging freely into the atmosphere. In one or more embodiments, the integral filter may be cleaned simply by detaching it from the portable vacuum cleaner 100, without requiring the use of tools, and shaking it vigorously, using a compressed air hose, or by rinsing it.

Figure 2:
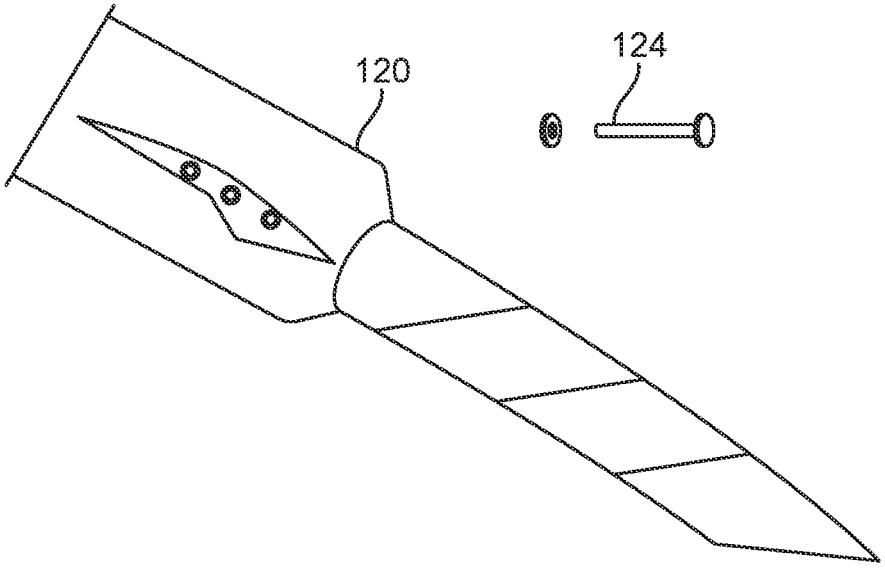
FIG. 2 exemplarily illustrates a nozzle assembly having a nozzle and an adjustable pin of the vacuum cleaner of FIG. 1.
Figure 3:
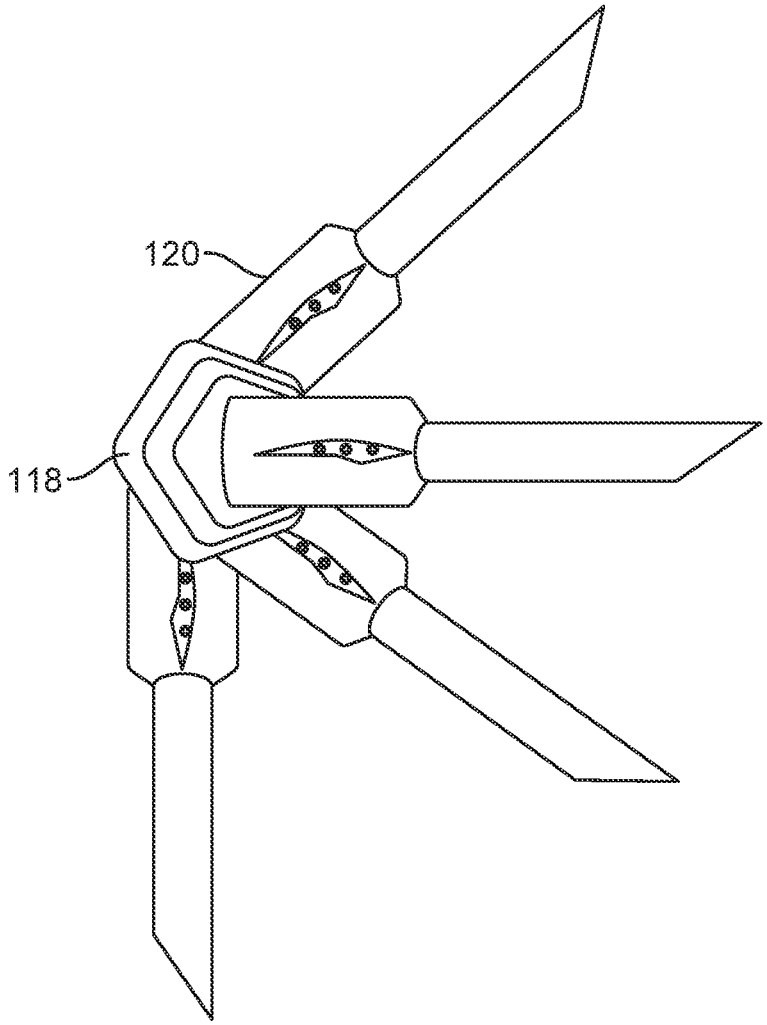
FIG. 3 exemplarily illustrates the nozzle assembly of the vacuum cleaner of FIG. 1.
Figure 4A:
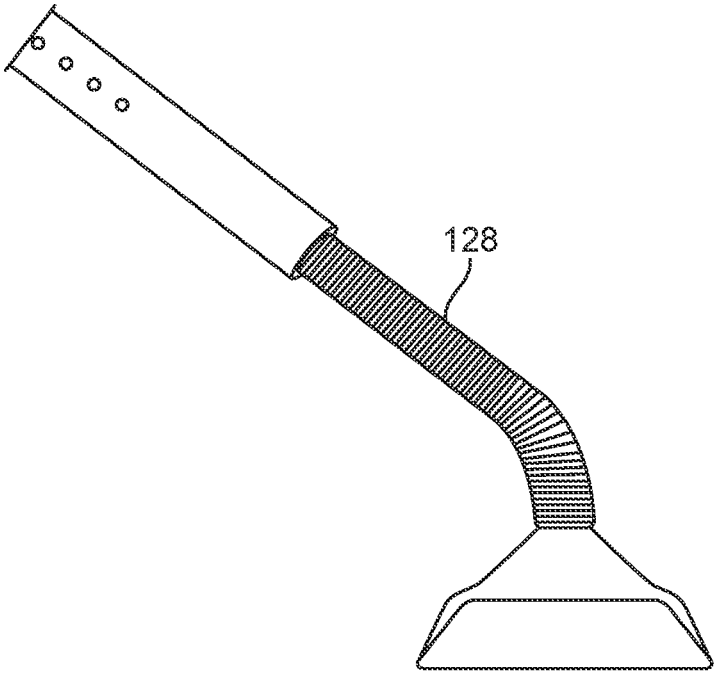
FIG. 4A exemplarily illustrates a perspective view of a vacuum hose for use with the vacuum cleaner of FIG. 1.
Figure 4B:
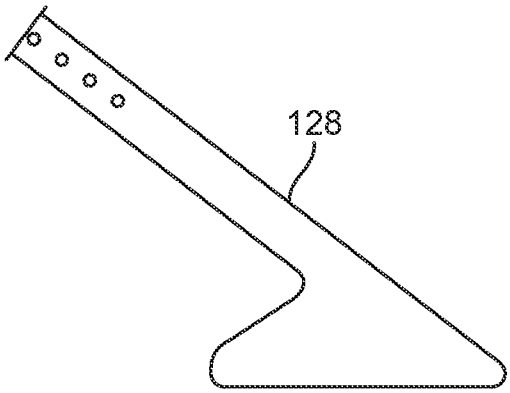
FIG. 4B exemplarily illustrates a perspective view of the vacuum hose for use with the vacuum cleaner FIG. 1.

Referring to FIG. 2, the nozzle assembly 102 generally includes a nozzle mount 118 and a nozzle 120. The nozzle mount 118 is rotatably coupled to the canister assembly 104 to spin about a rotation axis. The angled nozzle 120 rigidly extends from the nozzle mount 118 at an acute angle to the rotation axis. The nozzle 120 is adapted to rotate. The rotation of the nozzle 120 via the nozzle mount 118 is depicted in FIG. 3, wherein different positions of the nozzle 120 are depicted along a circular path. In another embodiment, the nozzle 120 is adapted to swing back-and-forth. In one embodiment, the nozzle assembly 102 is driven by the motor. In one embodiment, the nozzle 120 is long and slender in structure. Referring to FIG. 1, one or more control switches 122 are provided on housing 110 to control the vacuum cleaner. A nozzle adjusting assembly including an adjustable pin 124 and a lever 126 is mounted to the nozzle assembly 102 to rotate the nozzle mount 118. The rotation of the nozzle mount 118 in turn rotates the nozzle 120 and facilitates effective collection of dirt and debris. Referring to FIG. 4A and FIG. 4B, the vacuum cleaner 100 further includes a nozzle member including a vacuum hose 128, which is used for indoor cleaning and hard to reach places.

Figure 5:
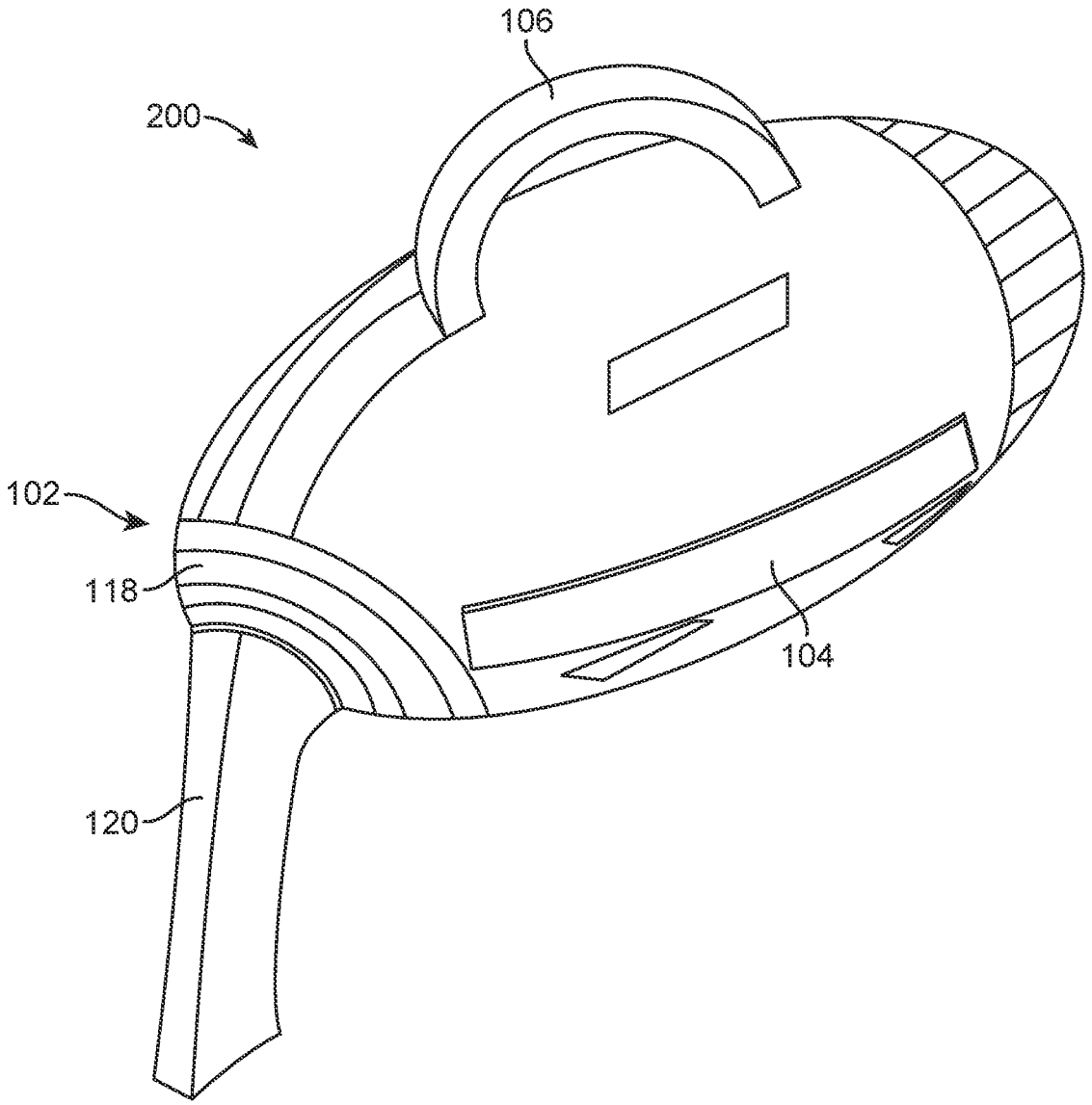
FIG. 5 exemplarily illustrates a perspective view of a portable vacuum cleaner, according to another embodiment of the present invention.
Figure 6:
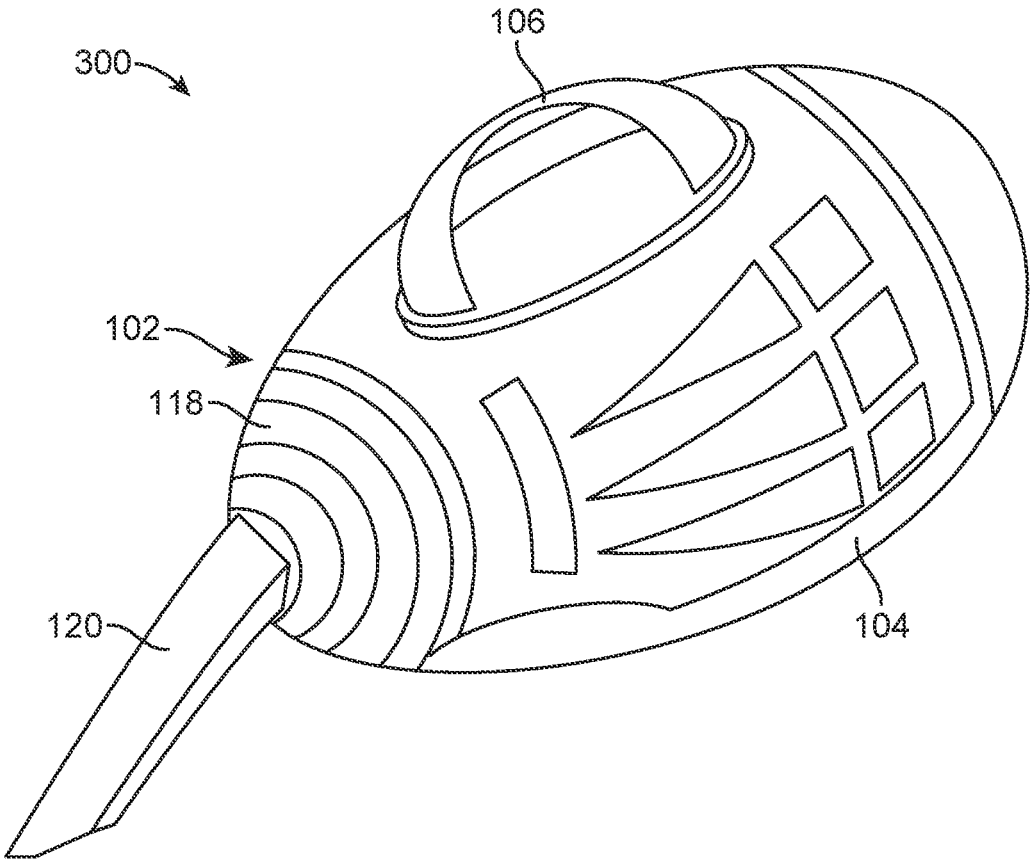
FIG. 6 exemplarily illustrates a perspective view of a portable vacuum cleaner, according to yet another embodiment of the present invention.

Referring to FIG. 5, a vacuum cleaner 200 according to another embodiment is disclosed. Referring to FIG. 6, a vacuum cleaner 300 according to yet another embodiment is disclosed. The vacuum cleaner 100 may include different designs as shown in FIG. 5 and FIG. 6. However, the components, functions, and operation are the same as that of the vacuum cleaner 100 described in reference to FIG. 1. Hence, for the explanation of components and operation of embodiments 200, 300, FIG. 1 description needs to be referred. Even though dust bag 112 is provided, at least one dust bag compartment is provided within the housing 110 to collect dirt and debris and achieves a more compact design. The dirt bag compartment may be provided with an exit door to discard the collected dirt and debris.

Referring to FIG. 3, in operation of the vacuum cleaner, dirt and debris from a surface such as a hard-to-reach corner is sucked into the nozzle cavity due to the maneuverability of the nozzle 120. The suction fan and drive motor generate negative air pressure which draws air including the entrained dust, dirt and debris from the nozzle cavity. The nozzle 120 could be flexibly rotated to find a path that allows the nozzle to reach and collect debris therefrom. The nozzle 120 is adapted to rotate. In another embodiment, the nozzle 120 is adapted to swing back-and-forth. In addition to the nozzle assembly 102, the handle 106 and the shoulder strap 108 allows the user to conveniently hold the cleaner 100 and move the cleaner side to side without having to maneuver the user body, and reach the desired area need to be cleaned. Then, the dirt and debris are delivered to the dust bag 112.

The dust bag 112 traps the dirt and debris but is sufficiently porous to allow the air to be drawn through the wall of the dust bag 112 into the dust bag compartment. From there the relatively clean air passes through the secondary filter (not shown) into the fan and drive motor compartment. The air then is drawn through the fan and is passed over the drive motor to provide cooling. The air then passes through the final filtration cartridge and is exhausted into the environment through the exhaust port 116. Further, the dirt bag 112 is detached from the vacuum cleaner 100 to discard the collected dirt and debris. Advantageously, the portable vacuum cleaner 100 can be used both indoors and outdoors, for example, cleaning automobiles, blowing leaves to sideways and professional landscaping jobs. Further, the slender nozzle 120 enables to easily clean couches, tight crevices, remove cobwebs from hard-to-reach places and remove dust from draperies. Further, the portable vacuum cleaner 100 is light weight, compact, efficient and saves time in cleaning, and reduces labor.

In some embodiments, the vacuum cleaners described in this application are configured to clean up a dry mess at ground level. In some embodiments, the vacuum cleaners are configured to clean up a dry mess at standing height on enclosed work sites. In some embodiments, the vacuum cleaners can be used on plywood, concrete or finished floors. In some embodiments, the vacuum cleaners can be used for mechanical, electrical and plumbing cleanup or maintenance, repair, and operations task cleanup. In some embodiments, the vacuum cleaners can clean up multiple floors with small, collected piles or punch list messes.

In some embodiments, the vacuum cleaners described in this application are configured to pick up sawdust and mixed debris up to 0.75 inches to 1 inch in diameter. In some embodiments, the vacuum cleaners can pick up nails, screws, nuts, metal knockouts that are up to 1 inch and washers that are up to 1 inch. In some embodiments, the vacuum cleaners can pick up drywall. In some embodiments, the vacuum cleaners can pick up small metal or PVC shavings. In some embodiments, the vacuum cleaners can be used in HVAC, electrical or tile trades.

In some embodiments, the vacuum cleaners described in this application have a compact form factor. In some embodiments, the vacuum cleaners provide a high level of suction. In some embodiments, the vacuum cleaners allow a high level of control. In some embodiments, the vacuum cleaners have quick operation. In some embodiments, the vacuum cleaners require little or no setup. In some embodiments, the vacuum cleaners are lightweight. In some embodiments, little or no bending of the operator is required in order to use the vacuum cleaners.

In some embodiments, accessories for use with the vacuum cleaners can be provided to certain tradesmen with smart storage options, such as rigid and flexible hoses, as well as floor, crevice and brush tools. In some embodiments, the vacuum cleaners are relatively quiet. As described above, the blower-vacuum apparatus according to the present invention is particularly advantageous in removing leaves, twigs, grass clippings and other organic accumulation from the surface of lawns and patios, while providing excellent portability and operability.

Although the features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A portable, hand-held vacuum cleaner, comprising:

a nozzle assembly including a nozzle cavity;

one or more batteries to power the nozzle assembly;

a canister assembly and a drive motor pivotally connected to the nozzle assembly, the canister assembly comprising a handle extending below a shoulder strap, the handle and the shoulder strap disposed on a top of the canister assembly;

a dust bag extending from a terminal end of the canister assembly;

a dirty air pathway providing fluid communication between the nozzle cavity and the dust bags; and a suction generator including a fan for generating a vacuum that draws dirt and debris from the nozzle cavity to the dust bag, wherein the nozzle assembly includes:

a nozzle mount rotatably coupled to a housing to allow the nozzle assembly to rotate about an axis of rotation extending from the center of the housing outward from a forward direction relative to the cleaner; and an angled nozzle rigidly extending from the nozzle mount at an acute angle to the rotation axis, wherein said nozzle is a long slender nozzle adapted to sway from side to side;

wherein the nozzle assembly is adapted to swing back and forth or rotate about the rotation axis via the drive motor;

wherein movement of the nozzle assembly is configured facilitate collection of dirt and debris; and a nozzle adjusting assembly including an adjustable pin and a lever mounted to the nozzle assembly.

2. The portable vacuum cleaner of claim 1, wherein the canister assembly includes a cavity, the cavity configured to house the drive motor and suction generator.

3. The portable vacuum cleaner of claim 1, further comprising a battery compartment configured to hold the one or more batteries.

4. The portable vacuum cleaner of claim 1, further comprising one or more control switches mounted on the canister assembly to control the portable vacuum cleaner.

* * * * *